US005573395A

United States Patent [19]

Althaus et al.

[11] Patent Number: 5,573,395

[45] Date of Patent: Nov. 12, 1996

[54] PREMIXING BURNER

[75] Inventors: Rolf Althaus, Kobe, Japan; Yau-Pin Chyou, Taipei, Taiwan

[73] Assignee: ABB Management AG, Baden, Switzerland

[21] Appl. No.: 383,580

[22] Filed: Feb. 3, 1995

[30] Foreign Application Priority Data

Apr. 2, 1994 [DE] Germany ..... 44 11 623.3

[51] Int. Cl.[6] ..... F23Q 9/00

[52] U.S. Cl. ..... 431/278; 431/175; 431/284; 431/182

[58] Field of Search ..... 431/283, 284, 431/285, 278, 174, 175

[56] References Cited

U.S. PATENT DOCUMENTS 3,283,802 11/1966 Farnham ..... 431/285
5,062,792 11/1991 Maghon ..... 431/284
5,244,380 9/1993 Dobbeling et al. ..... 431/284

FOREIGN PATENT DOCUMENTS 152551 3/1952 Australia ..... 431/174
0321809 6/1989 European Pat. Off. .

*Primary Examiner*—Carroll B. Dority
*Attorney, Agent, or Firm*—Burns, Doane, Swecker & Mathis

[57] ABSTRACT

A premixing burner comprises a pilot burner (101) operating on the double-cone principle and a plurality of main burners arranged around the pilot burner. A gaseous and/or liquid fuel is injected into the main burner (52), which has a circular duct (20), as a secondary flow into a gaseous main flow. The main flow is first of all guided over vortex generators (9), a plurality of which are arranged next to one another around the circumference of the duct (20) through which flow takes place.

7 Claims, 5 Drawing Sheets

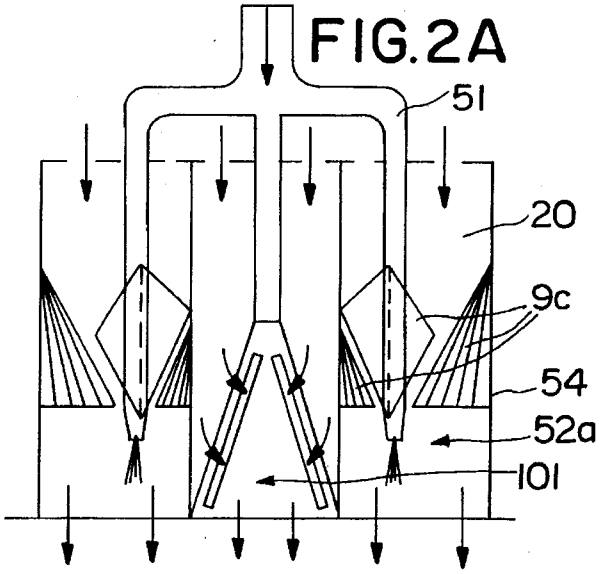
FIG.2A
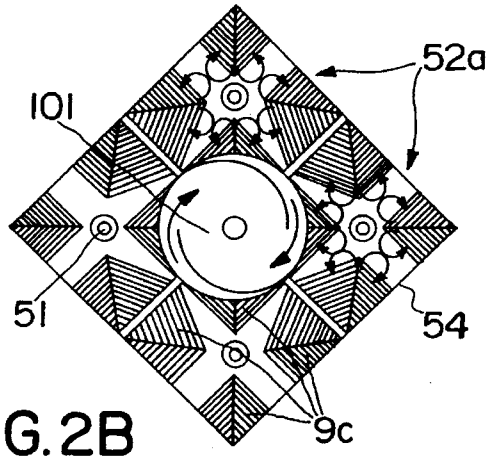
FIG.2B
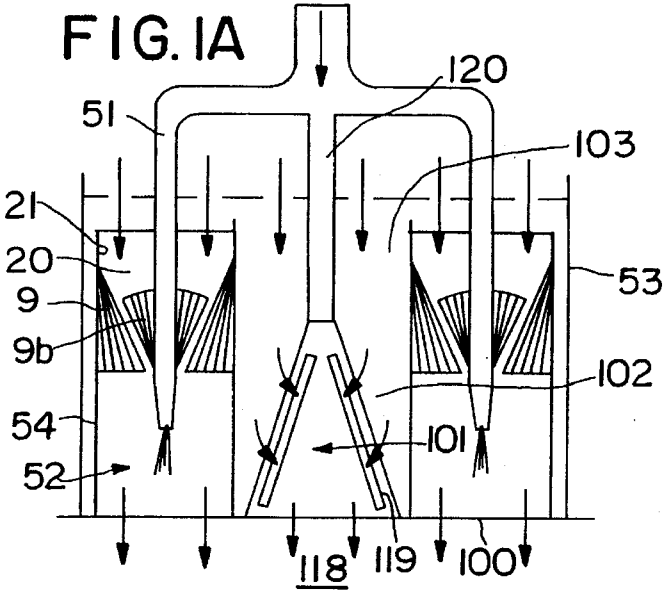
FIG. IA
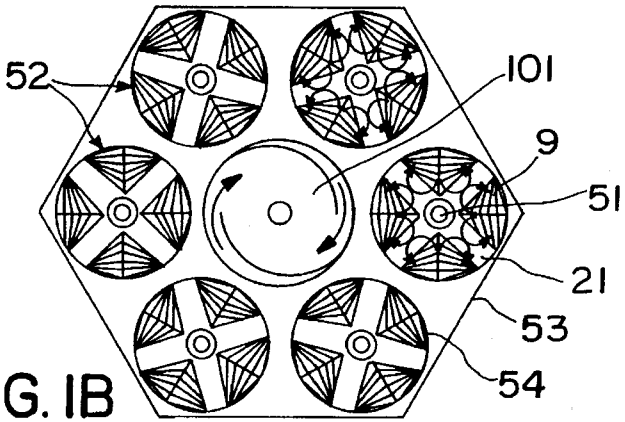
FIG. IB

PREMIXING BURNER

BACKGROUND OF THE INVENTION

1. Field of the Invention

The invention relates to a premixing burner, essentially comprising a pilot burner and a plurality of main burners arranged around the pilot burner.

2. Discussion of Background

Both in oil operation at very high pressure and in gas operation using gases containing a large amount of hydrogen, the ignition delay times in the case of premixing burners can be so short that flame-holding burners can no longer be used as so-called low-$NO_x$ burners.

The admixture of fuel to a combustion-air flow flowing in a premixing duct is generally performed by radial injection of the fuel into the duct by means of cross-jet mixers. However, the momentum of the fuel is so low that virtually complete mixing is achieved only after a distance of about 100 duct heights. Venturi mixers are also employed. The injection of the fuel via lattice arrangements is also known. Finally, injection ahead of special swirl-inducing bodies is also employed.

The devices operating on the basis of cross jets or laminar flows either result in very long mixing distances or require high injection momentums. In the case of premixing at high pressure and under substoichiometric mixing conditions, there is the risk of flashback of the flame or even self-ignition of the mixture. Flow separations and stagnation zones in the premixing tube, thick boundary layers on the walls or, in some cases, extreme velocity profiles across the cross section through which flow takes place can cause self-ignition in the tube or form paths by which the flame can flash back into the premixing tube from the combustion zone located downstream. Maximum attention must therefore be paid to the geometry of the premixing section.

The so-called premixing burners of the double-cone type may be referred to as flame-holding burners. Double-cone burners of this kind are known, for example, from U.S. Pat. No. 4,932,861 to Keller et al. and are described later with reference to FIGS. 1 and 3. The fuel, in that case natural gas, is injected in the inlet gaps into the combustion air flowing in from the compressor, via a row of injector nozzles. Generally speaking, these are distributed uniformly over the entire gap.

In order to achieve reliable ignition of the mixture in the downstream combustion chamber and sufficient burn-up, thorough mixing of the fuel with the air is required. Good mixing also contributes to the avoidance of so-called "hot spots" in the combustion chamber, these leading, inter alia, to the formation of the undesirable $NO_x$.

The abovementioned injection of the fuel by conventional means such as, for example, cross-jet mixers is difficult since the fuel itself has an insufficient momentum to achieve the necessary large-scale distribution and fine-scale mixing.

SUMMARY OF THE INVENTION

Accordingly, one object of the invention is to provide a novel measure in a premixing burner of the type mentioned at the outset by means of which thorough mixing of the combustion air and the fuel is achieved within the shortest possible distance with, at the same time, an even velocity distribution in the mixing zone. The intention is, furthermore, to prevent flashback of the flame with such a burner without using a mechanical flame holder. In addition, the measure is to be suitable for the retrofitting of existing premix combustion chambers.

According to the invention, this is achieved by virtue of the fact that a gaseous and/or liquid fuel is injected into the duct of the main burners as a secondary flow into a gaseous main flow, the main flow is guided over vortex generators, a plurality of which are arranged next to one another around the circumference of the duct through which flow takes place.

Using the novel statio mixer which the three-dimensional vortex generators represent, it is possible to achieve extremely short mixing distances in the main burners and, at the same time, a low pressure loss. By virtue of the generation of longitudinal vortices without a recirculation zone, rough mixing of the two flows is complete after just one full vortex rotation, while fine mixing due to turbulent flow and molecular diffusion processes is present after a distance which corresponds to just a few duct heights.

This type of mixing is particularly suitable for mixing the fuel at a relatively low upstream pressure and with great dilution into the combustion air. A low upstream pressure of the fuel is advantageous particularly when fuel gases of medium and low calorific value are used. The energy required for mixing is in large part taken from the flow energy of the fluid with the higher volume flow, namely the combustion air.

The advantage of such vortex generators is to be seen in their particular simplicity. From a manufacturing point of view, the element consisting of three walls around which flow takes place is completely unproblematic. The top surface can be joined to the two side surfaces in many different ways. The fixing of the element on flat or curved duct walls can moreover take place by means of simple welds in the case of weldable materials. From the point of view of fluid mechanics, the element exhibits a very low pressure loss when flow takes place around it and it generates vortices without a stagnation zone. Finally, the element can be cooled in many different ways and with various means because its internal space is in general hollow.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1A shows a longitudinal section of a burner;

FIG. 1B shows a front view of the burner shown in FIG. 1A;

FIG. 2A shows a longitudinal section of a variant embodiment of a burner;

FIG. 2B shows a front view of the variant embodiment shown in FIG. 2A;

DESCRIPTION OF THE PREFERRED EMBODIMENTS

Figure 3A:
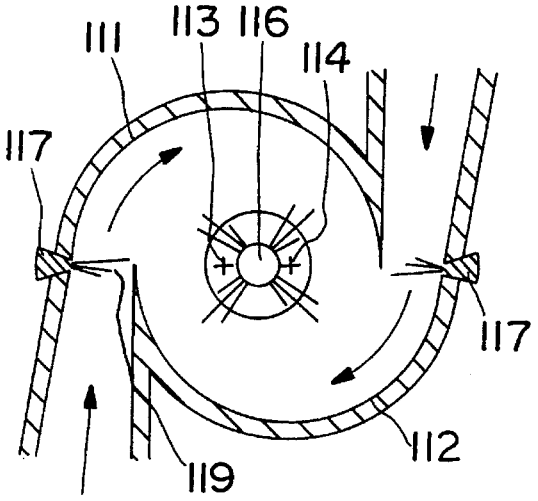
FIG. 3A shows a cross section through a premixing burner of the double-cone type in the region of its outlet.
Figure 3B:
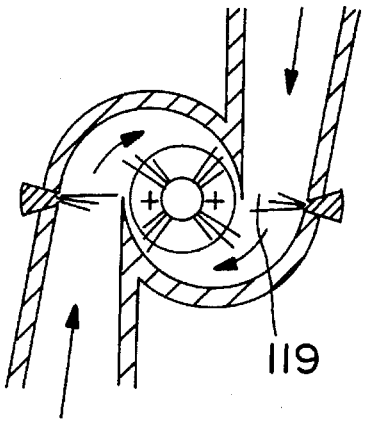
FIG. 3B shows a cross section through the same premixing burner in the region of the cone apex.

Referring now to the drawings, wherein like reference numerals designate identical or corresponding parts throughout the several views, where only the elements essential for the understanding of the invention are shown (elements such as casing, fastenings, conduit lead-throughs, the preparation of the fuel, the control devices and the like being omitted) and the flow direction of the working media is indicated by arrows, in FIGS. 1A and 1B, 53 designates a hexagonal burner wall. At an outlet end, the burner wall 53 is connected by suitable means to the front wall 100 of the combustion chamber (not shown). This combustion chamber can be either an annular combustion chamber or a silo combustion chamber and, in each case, a plurality of such burners are arranged on the front wall 100.

Inside the burner wall 53, six main burners 52 are grouped around a centrally arranged pilot burner 101. The pilot burner is a premixing burner of the double-cone type. The essential factor is that this pilot burner should have as small a geometry as possible. About 10–30% of the fuel should be burnt in it. The main burners 52 are cylindrical in shape. Arranged on the tubular wall 54 of each of maun burner's 52 there are in the direction of flow vortex generators 9 which are described further below. The fuel is fed to the pilot burner and the main burners via fuel inlets 120 and 51 respectively. The combustion air passes into the casing interior 103 from a plenum (not shown) and, from the casing interior, flows into the burners 101, 52 in the direction of the arrows.

The schematically represented premixing burner 101 shown in FIGS. 1A, 2A, 3A and 3B is a so-called double-cone burner as known, for example, from U.S. Pat. No. 4,932,861 to Keller et al. It consists essentially of two hollow conical partial bodies 111, 112 which are interleaved in the direction of flow. The respective center lines 113, 114 of the two partial bodies are offset relative to one another. The adjacent walls of the two partial bodies form along their length tangential gaps 119 for the combustion air, which in this way reaches the inside of the burner. Arranged there is a first fuel nozzle 116 for liquid fuel. The fuel is injected into the hollow cone at an acute angle. The conical fuel profile which arises is enclosed by the tangentially entering combustion air. The concentration of the fuel is continuously reduced in the axial direction because of the mixing with the combustion air. In the example, the burner is likewise operated with gaseous fuel. For this purpose, longitudinally distributed gas inlet openings 117 are provided in the walls of the two partial bodies in the region of the tangential gaps 119. In gas operation, mixture formation with the combustion air has thus already commenced in the zone of the inlet gaps 119. It is obvious that mixed operation with both types of fuel is also possible in this way.

A fuel concentration which is as homogeneous as possible over the annular cross section to which the mixture is admitted is established at the burner outlet 118. A defined cap-shaped reverse flow zone 121 is formed at the burner outlet (FIG. 15A) and ignition takes place at the apex of this zone. To this extent, double-cone burners are known from U.S. Pat. No. 4,932,861 to Keller et al. mentioned at the beginning.

Before detailing the installation of the mixing device in the main burners 52, a description will first of all be given of the vortex generator 9 essential for the manner in which the invention operates.

Figure 4:
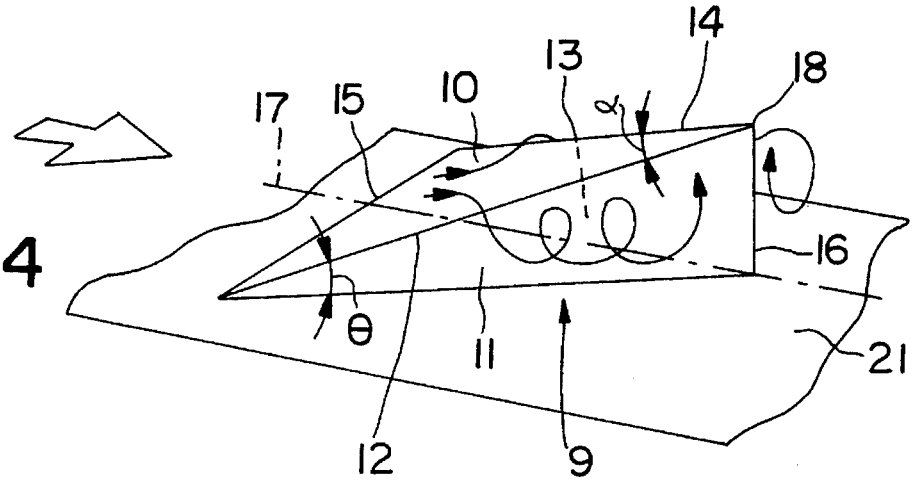
FIG. 4 shows a perspective representation of a vortex generator.
Figure 5:
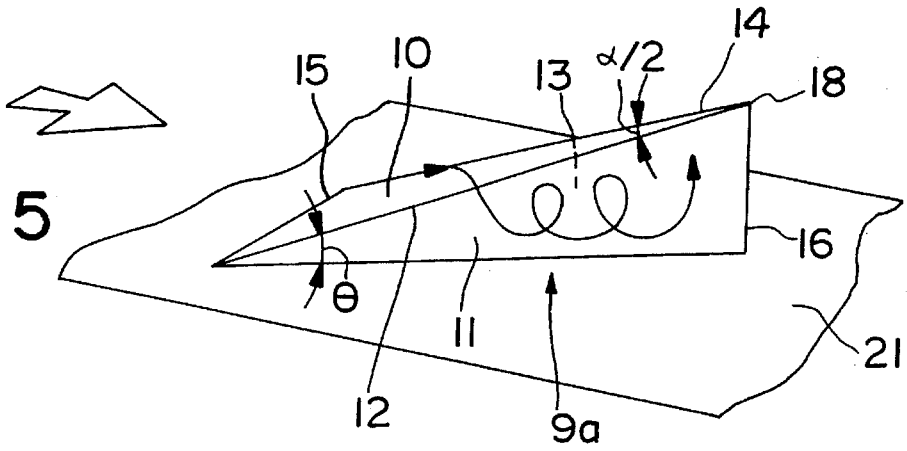
FIG. 5 shows a variant embodiment of the vortex generator.
Figure 6:
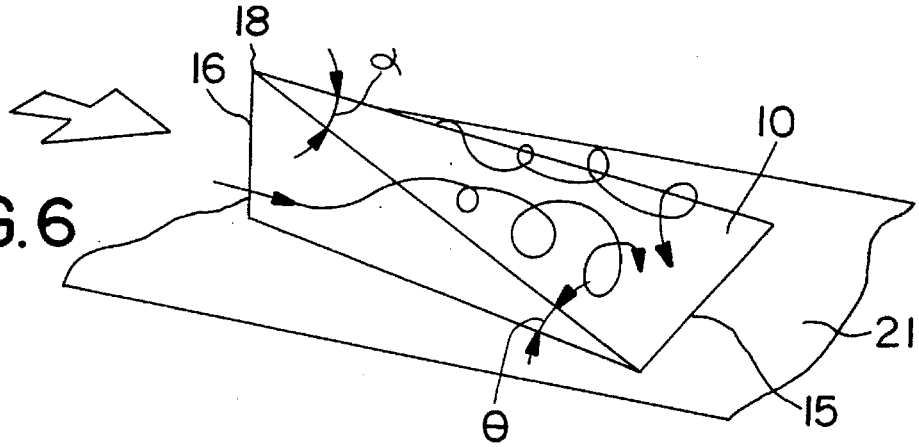
FIG. 6 shows a variant arrangement of the vortex generator shown in FIG. 4.

The actual duct through which flows a main flow symbolized by a large arrow is not shown in FIGS. 4, 5 and 6. According to these figures, a vortex generator consists essentially of three triangular surfaces around which flow can take place freely. These are a top surface 10 and two side surfaces 11 and 13. In their longitudinal direction, these surfaces extend at defined angles in the direction of flow.

The side walls of the vortex generator, which consist of right-angled triangles, are fixed by their longitudinal sides on a duct wall 21, preferably in a gastight manner. They are oriented in such a way that they form a V shaped joint at their narrow sides, enclosing an acute angle $\alpha$ referred to below as the "V-angle". The joint is designed as a sharp connecting edge 16 and is perpendicular to the duct wall 21 on which the side surfaces abut. In FIG. 4, the two side surfaces 11, 13 enclosing the V-angle $\alpha$ are symmetrical in shape, size and orientation and are arranged on both sides of an axis of symmetry 17. This axis of symmetry 17 runs in the same direction as the duct axis.

The top surface 10 lies with an edge 15 of very narrow design extending transversely to the duct through which flow takes place on the same duct wall 21 as the side walls 11, 13. Its longitudinally directed edges 12, 14 abut the longitudinally directed side surface edges protruding into the flow duct. The top surface extends at an angle of incidence $\theta$ to the duct wall 21. Its longitudinal edges 12, 14, together with the connecting edge 16, form a point 18.

The vortex generator can also, of course, be provided with a bottom surface by means of which it is fastened to the duct wall 21 in a suitable manner. Such a bottom surface, however, has no relationship to the mode of operation of the element.

In FIG. 4, the connecting edge 16 of the two side surfaces 11, 13 forms the downstream edge of the vortex generator. That edge 15 of the top surface 10 which extends transversely to the duct through which flow takes place is thus the edge which the duct flow meets first.

The mode of operation of the vortex generator is as follows: when flow occurs around the edges 12 and 14, the main flow is converted into a pair of opposing vortices. Their vortex axes are located in the axis of the main flow. The swirl number and the location of vortex breakdown, where the latter is desired at all, are determined by appropriate selection of the angle of incidence $\theta$ and of the V-angle $\alpha$. With increasing angles, the vortex strength and the swirl number are increased and the location of vortex breakdown moves upstream into the region of the vortex generator itself. Depending on the application, these two angles $\theta$ and $\alpha$ are determined by design requirements and by the process itself. It is then only necessary to adapt the length L of the element and the height h of the connecting edge 16 (FIG. 7).

FIG. 5 shows a so-called half "vortex generator" based on a vortex generator in accordance with FIG. 4, where only one of the two side surfaces of the vortex generator 9*a* is provided with the V-angle $\alpha/2$. The other side surface is straight and aligned in the direction of flow. In contrast to the symmetrical vortex generator, there is only one vortex in this case and it is generated on the angled side. In consequence, the field downstream of the vortex generator is not vortex-neutral; on the contrary, a swirl is imposed on the flow.

In FIG. 6, in contrast to FIG. 4, the sharp connecting edge 16 of the vortex generator 9 is the point which meets the duct flow first. The element is rotated by 180°. As can be seen from the representation, the two opposing vortices have changed their direction of rotation.

Figure 7:
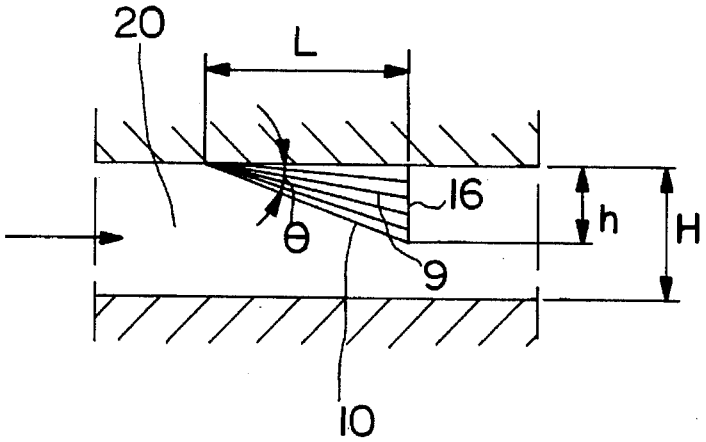
FIG. 7 shows a vortex generator in a duct.

According to FIG. 7, the vortex generators are installed in a duct 20. The height h of the connecting edge 16 will, as a rule, be matched to the duct height H—or to the height of the duct part to which vortex generator is assigned—in such a way that the vortex generated has already achieved such a size immediately downstream of the vortex generator that the complete duct height H is filled. This leads to a uniform velocity distribution in the cross section acted upon by the flow. A further criterion which can affect the ratio h/H to be chosen is the pressure drop which occurs when flow takes place around the vortex generator. It is obvious that as the ratio h/H increases, the pressure loss coefficient also increases.

In the example illustrated, four vortex generators 9 are, according to FIG. 1B, distributed at intervals around the circumference of the circular cross section for each of the six main burners. The above-discussed height of the duct part to which the individual vortex generator is assigned corresponds in this case to the circle radius. Obviously, the four vortex generators 9 could also be arranged side by side in the circumferential direction on their respective wall segments 21 in such a way that no spaces are left at the duct wall. In the final analysis, the vortex to be generated is the decisive factor here. In the free space between the vortex generators 9 there are also 4 vortex generators **9*b* grouped around the central burner lance 51. These are oriented in accordance with FIG. 6 such that the flow meets the sharp edge 16** first.

The vortex generators 9 and **9*b* are used primarily for mixing two flows. The main flow in the form of combustion air approaches the transversely directed inlet edges 15 or the connecting edges 16**, respectively in the direction of the arrow. The secondary flow in the form of a gaseous and/or liquid fuel has a considerably lower mass flow than the main flow. In the present case, it is introduced into the main flow downstream of the vortex generators.

According to FIGS. 1A and 1B, the fuel is injected in the case of the main burners 52 in each case by means of a central fuel lance 51. This lance is dimensioned for approximately 10% of the total volume flow through the duct 20. The figure shows longitudinal injection of the fuel in the direction of flow. In this case, the momentum of injection corresponds approximately to that of the momentum of the main flow. Cross-jet injection could equally well be provided, in which case the momentum of the fuel must then be about twice that of the main flow.

The injected fuel is entrained by the vortices and mixed with the main flow. It follows the helical course of the vortices and is evenly and finely distributed downstream of the vortices in the chamber. This reduces the risk of impact streaks on the opposite wall and the formation of so-called "hot spots"—which exist with the radial injection of fuel into an unswirled flow, as mentioned at the beginning.

Since the main mixing process takes place in the vortices and is largely independent of the momentum with which the secondary flow is injected, the fuel injection can be kept flexible and matched to other boundary conditions. As an example, the same momentum of injection can be retained over the whole load range. Since the mixing is determined by the geometry of the vortex generators, and not by the machine load, in the example the gas turbine power, the burner configured in this way operates in an optimum fashion ever under part-load conditions. The combustion process is optimized by matching the ignition delay time of the fuel and the mixing time of the vortices; this ensures a minimization of emissions.

In addition, the intensive mixing produces a good temperature profile over the cross section through which flow takes place and furthermore reduces the possibility of the occurrence of thermoacoustic instability. Simply by their presence, the vortex generators act as a damping measure against thermoacoustic vibrations.

The hexagonal shape of the burner described above is suitable for the honeycomb grouping, known per se, of such burners in silo combustion chambers.

FIGS. 2A and 2B show a burner with a rectangular external shape. A plurality of such elements could be arranged next to one another in the circumferential direction in an annular combustion chamber, for example, and thus form an independent interchangeable combustion module. This burner too essentially comprises a centrally arranged pilot burner 101, around which four main burners **52*a* are grouped. The pilot burner is likewise a premixing burner of the double-cone type with a cylindrical external outline. The main burners 52*a* are arranged directly on the outside of the double-cone burner without an interspace. The shape of the duct 20 through which flow takes place is determined by the rectangular external shape of the module and the circular boundary in the region of the conical burner. This shape is best exploited by arranging the vortex generators 9*c* directly in the module corners. In this extraordinarily compact burner, the elements 9*c*** of different sizes in the four main burners obviously generate vortices of different sizes.

In the examples shown in FIGS. 1 and 2, the fuel is fed to the pilot burner and to the main burners via central fuel inlets 120 and 51 respectively.

When the fuel is supplied in this way by means of a central lance, the vortex generators can be configured in such a way that downstream recirculation zones are very largely avoided. As a result, the dwell time of the fuel particles in the hot zones is very short and this has a favorable effect on minimum formation of $NO_x$. However, the vortex generators can also be configured in such a way and staggered over the depth of the duct 20 in such a way that a defined reverse flow zone arises at the outlet of the main burners, this reverse flow zone stabilizing the flame aerodynamically, ie. without a mechanical flame holder.

FIGS. 8 to 14 show, in relation to the main burners, further possible ways of introducing the fuel into the combustion air. These variants can be combined with one another and with a central fuel injection arrangement in many different ways.

Figure 8:
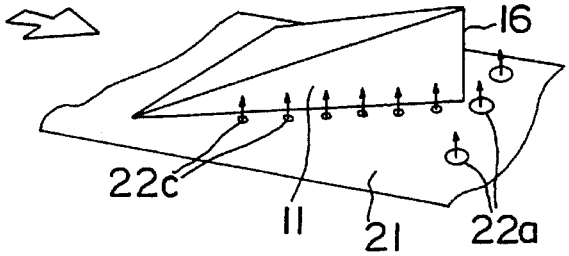
FIGS. 8 to 14 show variants in the way the fuel is supplied.

According to FIG. 8, the fuel is, in addition to being injected through wall holes **22*a* downstream of the vortex generators, also injected via wall holes 22*c* which are situated immediately adjacent to the side walls 11, 13 and along their length in the same wall 21 on which the vortex generators are arranged. The introduction of the fuel through the wall holes 22*c*** imparts to the vortices generated an additional momentum, thereby increasing their life.

Figure 9:
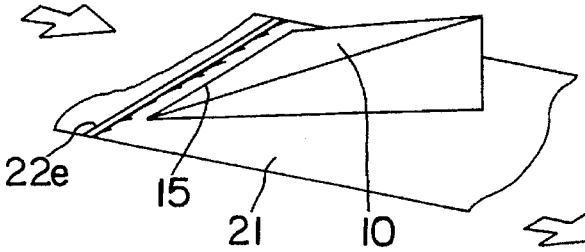
Figure 10:
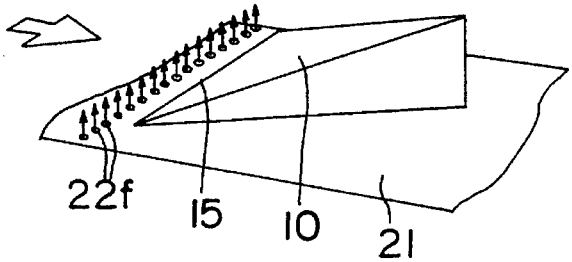

According to FIGS. 9 and 10, the fuel is injected, on the one hand, via a slot **22*e* and, on the other hand, via wall holes 22*f* situated immediately in front of that edge 15 of the top surface 10 which extends transversely to the duct through which flow takes place and are located along the length of the said edge in the same wall 21 on which the vortex generators are arranged. The geometry of the wall holes 22***f* or of the slot 22*e* is chosen in such a way that the fuel is injected into the main flow at a particular injection angle and flows around the downstream vortex generator as a film which confers protection against the hot main flow.

In the examples described below, the secondary flow is introduced first into the hollow interior of the vortex generator through the duct wall 21 by means not shown. This provides an internal cooling facility for the vortex generators.

Figure 11:
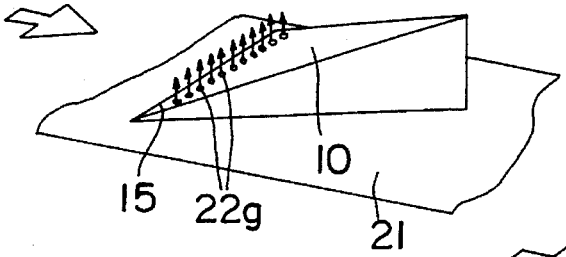

According to FIG. 11, the fuel is injected via wall holes 22*g* which are located in the top surface 10 directly behind and along the length of the edge 15 extending transversely to the duct through which flow takes place. Here, the cooling of the vortex generator is more external than internal. As it flows around the top surface 10, the emerging secondary flow forms a protective layer which shields the said surface from the hot main flow.

Figure 12:
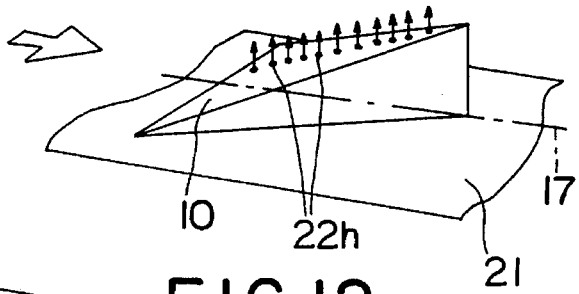

According to FIG. 12, the fuel is injected via wall holes 22*h* which are disposed in a staggered arrangement in the top surface 10 along the line of symmetry 17. In this variant, the duct walls are provided with particularly efficient protection from the hot main flow since the fuel is introduced first at the outer periphery of the vortices.

Figure 13:
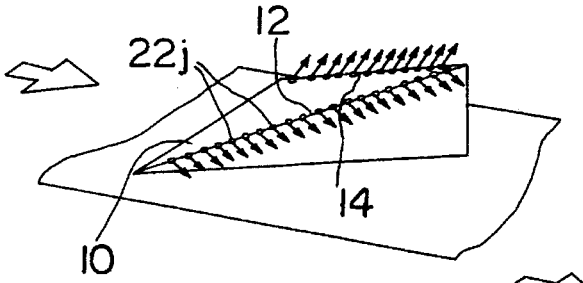

According to FIG. 13, the fuel is injected via wall holes 22*j* which are located in the longitudinally directed edges 12, 14 of the top surface 10. This solution ensures efficient cooling of the vortex generators since the fuel emerges at their extremities and thus flows fully around the inner walls of the element. The secondary flow is here introduced directly into the vortex which arises, leading to defined flow conditions.

Figure 14:
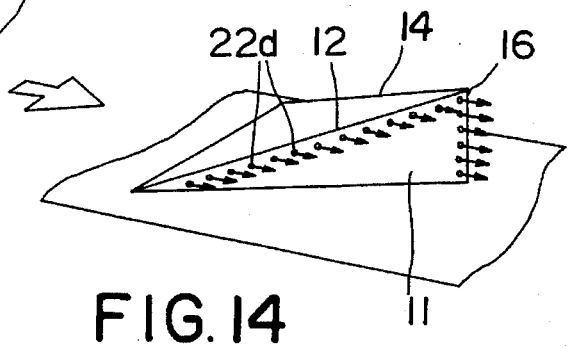

In FIG. 14, injection is performed via wall holes 22*d* located in the side surfaces 11 and 13, on the one hand in the region of the longitudinal edges 12 and 14 and on the other hand in the region of the connecting edge 16. This variant is similar in its action to that where the fuel emerges from the holes 22*a* (in FIG. 8) and from the holes 22*j* (in FIG. 11).

With the burners described, part-load operation of combustion chambers is simple to achieve by graduated fuel supply to the individual modules. Depending on the operating concept, the central pilot burner can be operated in a hybrid mode, for example with a diffusion flame at low loads and a changeover to premix combustion at higher loads. This possibility satisfies the requirements with respect to stability and burn-up. If the pilot burner is operated on its own with a premixed flame, the main flow of the main burners is used as diluting air. This highly turbulent main flow mixes very rapidly at the outlet of the main burners with the hot gases emerging from the pilot stage. An even temperature profile is thus produced downstream. To increase the load on the burner, fuel is injected in stages into the main burners and mixed thoroughly into the combustion air before ignition. These main burners operate in premix mode at all times; they are ignited and stabilized by the pilot burner.

The burner aerodynamics consist of two radially graduated vortex patterns. The radially outer vortices are dependent on the number and geometry of the vortex generators 9. The radially inner vortex structure emanating from the double-cone burner can be influenced by adapting certain geometric parameters of the double-cone burner. The quantity distribution between the pilot burner and the main burners can be effected as desired by appropriate matching of the areas through which flow takes place, a procedure in which pressure losses are to be taken into account. Because the vortex generators exhibit a relatively low pressure loss, the flow through the main burners can take place at a higher speed than that through the pilot burner. A higher speed at the outlet of the main burners has a favorable effect as regards the flashing back of the flame.

Figure 15A:
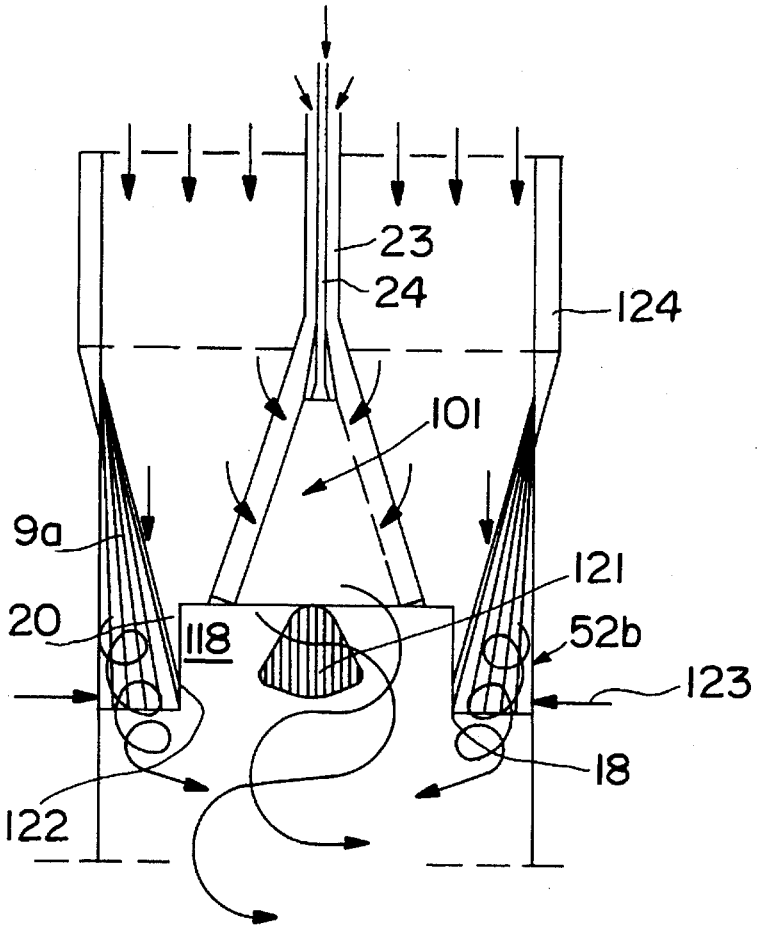
FIG. 15A shows a longitudinal section of a further variant embodiment of a burner.
Figure 15B:
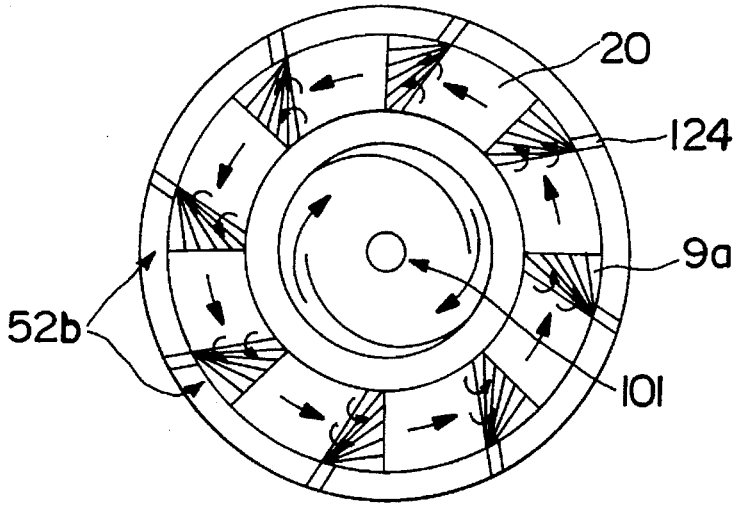
FIG. 15B shows a front view of the variant embodiment shown in FIG. 15A.

FIGS. 15A and 15B present a circular burner in which the radially graduated vortex patterns as described above are precisely defined. The radially inner, large-scale vortex and the radially outer vortex rotate in opposite directions. In order to achieve this, a number of vortex generators 9*a* as shown in FIG. 5 are grouped around the double-cone burner 101. These are so-called half vortex generators where only one of the two side surfaces of the vortex generator 9*a* is provided with the V-angle $\alpha/2$. The other side surface is straight and aligned with the burner axis. In contrast to the symmetrical vortex generator, only one vortex is generated here, on the angled side. In consequence, the field downstream of the vortex generator is not vortex-neutral; swirl is, on the contrary, imposed on the flow. When the vortex generators distributed uniformly in the circumferential direction all have the same orientation, the originally swirl-free main flow forms a unidirectional swirl around the circumference downstream of the vortex generators, as indicated in FIG. 15B.

In this example, the pilot burner is set back somewhat relative to the vortex generators 9*a*, in the direction of flow. This double-cone burner is fitted with a central oil lance 24 and a gas lance 23, both separate and mixed fuel operation being possible. The side walls 122 bounding the combustion space 118 form the inner wall of the annular flow duct 20 of the main burners 52*b*. The points 18 of the vortex generators 9*a* are located in the plane of the outlet of the main burners and are connected to the wall 122. As indicated by the arrows 123, there is the possibility here of passing cooling air to the central body through the hollow interior and the point of the vortex generators 9*a*. The fuel is supplied to the main burners via ducts 124. These ducts open into the burner duct 20 upstream of the vortex generators.

Such a configuration is well-suited to form an independent compact burner unit. When a plurality of such units are used, for example in an annular combustion chamber of a gas turbine, the swirl imposed on the outer main flow can be used to improve the transverse ignition behavior of the burner configuration, for example at part load.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A premixing burner, comprising:

a centrally arranged pilot burner having a mixing space with an outlet and means for introducing air and fuel into the mixing space for mixing before exiting through the outlet;

a plurality of main burners each having a duct for guiding a gaseous main flow of air, the main burners being arranged around the pilot burner;

means for injecting at least one of a gaseous and liquid fuel into the duct of each of the main burners as a secondary flow into the gaseous main flow for mixing the fuel and main flow in the duct; and, a plurality of vortex generators mounted in the duct of each of the main burners upstream of an outlet of the main burner, the vortex generators arranged next to one another around a circumference of the duct, each vortex generator comprising a body projecting into the main burner duct and having a shape for creating vortices with an axis substantially parallel to a flow axis of the main burner.

2. The premixing burner as claimed in claim 1, wherein the pilot burner comprises two hollow conical partial bodies positioned to define a conical space aligned in the direction of flow, the partial bodies being positioned with respective center lines offset relative to one another so that adjacent walls of the two partial bodies form along their length longitudinal ducts for a tangentially directed flow of combustion air into the conical space and longitudinally distributed gas inlet openings provided in the walls of the two partial bodies in the region of the longitudinal ducts.

3. The premixing burner as claimed in claim 1, wherein each vortex generator has three surfaces around which flow can take place freely, which surfaces extend in the direction of flow, a first surface forming a top surface and a second and third surface forming side surfaces, wherein the side surfaces abut a same wall segment of the duct and meet at an acute angle to form a V-shape, wherein the top surface is oriented at an angle to the duct wall and an edge of the top surface contacts the duct wall extending transversely to the flow direction at the same wall segment as the side walls, and wherein longitudinally directed edges of the top surface abut longitudinally directed side surface edges protruding into the flow duct.

4. A premixing burner, comprising:

a centrally arranged pilot burner, comprising two hollow conical partial bodies positioned to define a conical space aligned in the direction of flow, the partial bodies being positioned with respective center lines offset relative to one another so that adjacent walls of the two partial bodies form along their length longitudinal ducts for a tangentially directed flow of combustion air into the conical space and longitudinally distributed gas inlet openings provided in the walls of the two partial bodies in the region of the longitudinal ducts;

a plurality of main burners each having a duct arranged around the pilot burner;

means for injecting at least one of a gaseous and liquid fuel into the duct of each of the main burners as a secondary flow into a gaseous main flow; and, a plurality of vortex generators mounted in the duct of each of the main burners upstream of an outlet of the main burner, the vortex generators arranged next to one another around a circumference of the duct.

5. The premixing burner as claimed in claim 4, wherein each vortex generator has three surfaces around which flow can take place freely, which surfaces extend in the direction of flow, a first surface forming a top surface and a second and third surface forming side surfaces, wherein the side surfaces abut a same wall segment of the duct and meet at an acute angle to form a V-shape, wherein the top surface is oriented at an angle to the duct wall and an edge of the top surface contacts the duct wall extending transversely to the flow direction at the same wall segment as the side walls, and wherein longitudinally directed edges of the top surface abut longitudinally directed side surface edges protruding into the flow duct.

6. A premixing burner, comprising:

a centrally arranged pilot burner;

a plurality of main burners each having a duct arranged around the pilot burner;

means for injecting at least one of a gaseous and liquid fuel into the duct of each of the main burners as a secondary flow into a gaseous main flow; and, a plurality of vortex generators mounted in the duct of each of the main burners upstream of an outlet of the main burner, the vortex generators arranged next to one another around a circumference of the duct, wherein each vortex generator has three surfaces around which flow can take place freely, which surfaces extend in the direction of flow, a first surface forming a top surface and a second and third surface forming side surfaces, wherein the side surfaces abut a same wall segment of the duct and meet at an acute angle to form a V-shape, wherein the top surface is oriented at an angle to the duct wall and an edge of the top surface contacts the duct wall extending transversely to the flow direction at the same wall segment as the side walls, and wherein longitudinally directed edges of the top surface abut longitudinally directed side surface edges protruding into the flow duct.

7. The premixing burner as claimed in claim 6, wherein the pilot burner comprises two hollow conical partial bodies positioned to define a conical space aligned in the direction of flow, the partial bodies being positioned with respective center lines offset relative to one another so that adjacent walls of the two partial bodies form along their length longitudinal ducts for a tangentially directed flow of combustion air into the conical space and longitudinally distributed gas inlet openings provided in the walls of the two partial bodies in the region of the longitudinal ducts.

* * * * *